US009814334B2

(12) United States Patent
Eickhoff et al.

(10) Patent No.: US 9,814,334 B2
(45) Date of Patent: Nov. 14, 2017

(54) DRINK CUP LID

(71) Applicant: Berry Plastics Corporation, Evansville, IN (US)

(72) Inventors: Jonathan Eickhoff, Evansville, IN (US); Jordan French, Evansville, IN (US)

(73) Assignee: Berry Plastics Corporation, Evansville, IN (US)

( * ) Notice: Subject to any disclaimer, the term of this patent is extended or adjusted under 35 U.S.C. 154(b) by 76 days.

(21) Appl. No.: 14/921,540

(22) Filed: Oct. 23, 2015

(65) Prior Publication Data

US 2016/0113424 A1 Apr. 28, 2016

Related U.S. Application Data

(60) Provisional application No. 62/068,320, filed on Oct. 24, 2014.

(51) Int. Cl.

| | |
|---|---|
| ***B65D 43/06*** | (2006.01) |
| ***A47G 19/22*** | (2006.01) |
| ***B65D 47/08*** | (2006.01) |

(52) U.S. Cl.

CPC ..... *A47G 19/2272* (2013.01); *B65D 47/0833* (2013.01); *B65D 2251/1008* (2013.01)

(58) Field of Classification Search

CPC ..... B65D 43/0212; B65D 47/0847; B65D 47/00; B65D 47/04; B65D 47/06; B65D 47/065; B65D 47/068; B65D 47/08; B65D 47/0804; B65D 47/0809; B65D 47/0833

USPC .... 220/254.3, 832, 712, 711, 713, 719, 789, 220/715

See application file for complete search history.

(56) References Cited

U.S. PATENT DOCUMENTS

| | | | |
|---|---|---|---|
| 1,395,594 | A | 11/1921 | Pfefferle |
| 1,755,042 | A | 4/1930 | Zoller |
| 1,773,972 | A | 8/1930 | Eberhart |
| 1,940,088 | A | 12/1933 | Harrison |
| 2,015,028 | A | 9/1935 | Gillette |
| 2,050,487 | A | 8/1936 | Durrant |
| 2,120,403 | A | 6/1938 | Godfrey |
| D111,097 | S | 8/1938 | White |
| 2,174,618 | A | 10/1939 | Burdick |
| 2,271,589 | A | 2/1942 | Hendrickson |
| 2,374,092 | A | 4/1945 | Glaser |
| 2,649,984 | A | 8/1953 | Abt |

(Continued)

FOREIGN PATENT DOCUMENTS

| | | |
|---|---|---|
| CN | 3107990 | 1/1999 |
| CN | 99813627 | 1/1999 |

(Continued)

OTHER PUBLICATIONS

Extended European Search Report for European Patent Application No. 14768275.1, dated Sep. 14, 2016, 7 pages.

(Continued)

*Primary Examiner* — Steven A. Reynolds
*Assistant Examiner* — Javier A Pagan
(74) *Attorney, Agent, or Firm* — Barnes & Thornburg LLP

(57) ABSTRACT

A package includes a cup for storing liquids and a lid for mounting on a brim of the cup. The lid is formed to include a sipping feature so that a consumer can drink liquid from the cup while the lid is mounted on the brim.

11 Claims, 9 Drawing Sheets

(56) References Cited

U.S. PATENT DOCUMENTS

| | | | |
|---|---|---|---|
| 2,766,796 | A | 10/1956 | Tupper |
| 2,985,354 | A | 5/1961 | Aldington |
| 3,048,317 | A | 8/1962 | Cochrane |
| 3,055,540 | A | 9/1962 | Ringlen |
| 3,065,875 | A | 11/1962 | Negoro |
| 3,071,281 | A | 1/1963 | Sawai |
| 3,103,224 | A | 9/1963 | Dearling |
| 3,128,903 | A | 4/1964 | Crisci |
| 3,245,691 | A | 4/1966 | Gorman |
| 3,262,602 | A | 7/1966 | McConnell |
| 3,269,734 | A | 8/1966 | Ottofy |
| 3,301,459 | A | 1/1967 | Gardner |
| 3,329,304 | A | 7/1967 | Crisci |
| 3,329,305 | A | 7/1967 | Crisci |
| 3,349,950 | A | 10/1967 | Wanderer |
| 3,421,653 | A | 1/1969 | Whaley |
| 3,433,378 | A | 3/1969 | Ross |
| 3,524,566 | A | 8/1970 | Parks |
| 3,561,668 | A | 2/1971 | Bergstrom |
| 3,583,596 | A | 6/1971 | Brewer |
| D221,420 | S | 8/1971 | Davis |
| 3,604,588 | A | 9/1971 | Winnick |
| 3,609,263 | A | 9/1971 | Clementi |
| 3,610,306 | A | 10/1971 | Summers |
| 3,612,342 | A | 10/1971 | Rath bun |
| 3,624,787 | A | 11/1971 | Newman |
| D222,905 | S | 2/1972 | Kinney |
| 3,676,089 | A | 7/1972 | Swett |
| 3,677,435 | A | 7/1972 | Davis |
| 3,679,088 | A | 7/1972 | Swett |
| 3,679,089 | A | 7/1972 | Swett |
| D226,063 | S | 1/1973 | Warnberg |
| 3,734,276 | A | 5/1973 | Bank |
| 3,743,133 | A | 7/1973 | Rathbun |
| 3,745,055 | A | 7/1973 | Gorman |
| 3,746,158 | A | 7/1973 | Connick |
| 3,768,688 | A | 10/1973 | Linke |
| 3,805,991 | A | 4/1974 | Cheladze |
| 3,817,420 | A | 6/1974 | Heisler |
| 3,840,144 | A | 10/1974 | Dry |
| D233,599 | S | 11/1974 | Davis |
| RE28,797 | E | 5/1976 | Brewer |
| 3,977,563 | A | 8/1976 | Holt |
| 4,006,839 | A | 2/1977 | Thiel |
| 4,007,936 | A | 2/1977 | Hornsby |
| 4,018,355 | A | 4/1977 | Ando |
| 4,026,459 | A | 5/1977 | Blanchard |
| 4,054,229 | A | 10/1977 | Arfert |
| 4,074,827 | A | 2/1978 | Labe |
| 4,078,686 | A | 3/1978 | Karesh |
| 4,190,174 | A | 2/1980 | Haimowitz |
| 4,194,645 | A | 3/1980 | Zabner |
| 4,210,258 | A | 7/1980 | von Holdt |
| D256,558 | S | 8/1980 | Smith |
| D258,576 | S | 3/1981 | Smith |
| 4,266,689 | A | 5/1981 | Asher |
| 4,293,080 | A | 10/1981 | Letica |
| D264,690 | S | 6/1982 | Bagwell |
| 4,349,119 | A | 9/1982 | Letica |
| 4,351,448 | A | 9/1982 | Ingersoll |
| 4,380,305 | A | 4/1983 | Von Holdt |
| 4,389,802 | A | 6/1983 | McLaren |
| 4,408,698 | A | 10/1983 | Ballester |
| 4,421,244 | A | 12/1983 | Van Melle |
| 4,444,332 | A | 4/1984 | Widen |
| 4,446,986 | A | 5/1984 | Bowen |
| 4,474,305 | A | 10/1984 | Marco |
| 4,508,235 | A | 4/1985 | Steele |
| 4,518,097 | A | 5/1985 | Milton |
| 4,524,882 | A | 6/1985 | Buc |
| 4,562,937 | A | 1/1986 | Iyengar |
| D286,026 | S | 10/1986 | Rayner |
| 4,629,088 | A | 12/1986 | Durgin |
| 4,640,434 | A | 2/1987 | Johnsen |
| 4,640,435 | A | 2/1987 | Dutt |
| 4,674,644 | A | 6/1987 | Jacobs |
| 4,679,699 | A | 7/1987 | Malsbury |
| D292,380 | S | 10/1987 | Smith |
| 4,721,210 | A | 1/1988 | Lawrence |
| 4,782,976 | A | 11/1988 | Kenyon |
| 4,799,602 | A | 1/1989 | Collins |
| 4,836,407 | A | 6/1989 | Bruce |
| 4,872,586 | A | 10/1989 | Landis |
| 4,886,184 | A | 12/1989 | Chamourian |
| 4,934,557 | A | 6/1990 | Smith |
| D309,564 | S | 7/1990 | Rayner |
| 4,971,211 | A | 11/1990 | Lake |
| 5,064,082 | A | 11/1991 | Lombardi |
| 5,099,232 | A | 3/1992 | Howes |
| 5,111,961 | A | 5/1992 | Van Melle |
| 5,151,233 | A | 9/1992 | Wendt |
| 5,180,079 | A | 1/1993 | Jeng |
| D339,027 | S | 9/1993 | Mack |
| 5,375,828 | A | 12/1994 | Shikami |
| 5,377,860 | A | 1/1995 | Littlejohn |
| 5,390,810 | A | 2/1995 | Stroble |
| 5,397,023 | A | 3/1995 | Toczek |
| 5,398,843 | A | 3/1995 | Warden |
| 5,427,266 | A | 6/1995 | Yun |
| 5,460,286 | A | 10/1995 | Rush |
| 5,489,026 | A | 2/1996 | DAloia |
| 5,509,568 | A | 4/1996 | Warden |
| 5,524,788 | A | 6/1996 | Plester |
| 5,531,347 | A | 7/1996 | Goulding |
| 5,542,532 | A | 8/1996 | Mitchell |
| D374,822 | S | 10/1996 | Philips |
| 5,592,766 | A | 1/1997 | Mygatt |
| 5,613,619 | A | 3/1997 | Van Melle |
| 5,641,063 | A | 6/1997 | Gambardella |
| D380,385 | S | 7/1997 | Litke |
| D381,267 | S | 7/1997 | Rush |
| D384,580 | S | 10/1997 | Fernandes |
| 5,713,463 | A | 2/1998 | Lakoski |
| 5,722,558 | A | 3/1998 | Thompson |
| 5,746,312 | A | 5/1998 | Johnson |
| 5,769,263 | A | 6/1998 | Willingham |
| 5,791,509 | A | 8/1998 | Rush |
| 5,806,707 | A | 9/1998 | Boehm |
| 5,820,016 | A | 10/1998 | Stropkay |
| 5,829,583 | A | 11/1998 | VerWeyst |
| 5,839,601 | A * | 11/1998 | Van Melle ..... B65D 43/0256 220/254.3 |
| 5,894,952 | A | 4/1999 | Mendenhall |
| 5,913,964 | A | 6/1999 | Melton |
| 5,947,323 | A | 9/1999 | Freek |
| 5,979,690 | A | 11/1999 | Hartley |
| 6,021,917 | A | 2/2000 | Lovell |
| 6,056,144 | A | 5/2000 | Strange |
| 6,070,752 | A | 6/2000 | Nava |
| D437,223 | S | 2/2001 | Coy |
| 6,196,404 | B1 | 3/2001 | Chen |
| 6,196,411 | B1 | 3/2001 | Nava |
| 6,216,857 | B1 | 4/2001 | Gordon |
| 6,257,435 | B1 | 7/2001 | Chedister |
| 6,257,629 | B1 | 7/2001 | Weichelt |
| 6,299,014 | B1 | 10/2001 | Nava |
| 6,302,288 | B1 | 10/2001 | Nava |
| 6,311,860 | B1 | 11/2001 | Reidinger |
| D452,155 | S | 12/2001 | Stodd |
| 6,330,943 | B1 | 12/2001 | Gordon |
| 6,349,821 | B1 | 2/2002 | Gordon |
| 6,357,619 | B1 | 3/2002 | Schaefer |
| 6,364,102 | B1 | 4/2002 | Gordon |
| 6,371,289 | B1 | 4/2002 | Gordon |
| 6,404,730 | B2 | 6/2002 | Yeo |
| 6,412,629 | B1 | 7/2002 | Gordon |
| 6,419,112 | B1 | 7/2002 | Bruce |
| 6,454,087 | B2 | 9/2002 | Gordon |
| 6,460,716 | B1 | 10/2002 | Wong |
| 6,464,072 | B2 | 10/2002 | Gordon |
| 6,478,148 | B2 | 11/2002 | Gordon |
| 6,481,573 | B2 | 11/2002 | Gordon |
| D469,693 | S | 2/2003 | Weiss |
| 6,533,114 | B1 | 3/2003 | Gordon |

(56) References Cited

U.S. PATENT DOCUMENTS 6,557,698 B2 5/2003 Gordon
6,561,345 B2 5/2003 Gordon
6,571,943 B2 6/2003 Gordon
6,588,182 B2 7/2003 Gordon
6,598,741 B2 7/2003 Gordon
6,604,629 B2 8/2003 Gordon
6,612,456 B1 * 9/2003 Hundley ..... B65D 43/0212 220/254.1
6,625,959 B2 9/2003 Gordon
6,626,288 B2 9/2003 Gordon
6,647,696 B2 11/2003 Gordon
6,648,134 B2 11/2003 Gordon
6,688,487 B2 2/2004 Oakes
6,840,375 B2 1/2005 Gordon
D502,050 S 2/2005 Munson
6,874,649 B2 4/2005 Clarke
6,886,707 B2 5/2005 Giraud
6,889,860 B2 5/2005 Mazzarolo
6,910,599 B2 6/2005 Tucker
6,929,143 B2 8/2005 Mazzarolo
6,932,234 B2 8/2005 DAmato
6,948,633 B2 9/2005 Freek
6,959,829 B2 11/2005 Crider
D516,910 S 3/2006 Bresler
D517,322 S 3/2006 Zettle
D519,374 S 4/2006 Hornke
D521,382 S 5/2006 Gross
7,055,715 B2 6/2006 Maravich
7,063,224 B2 6/2006 Clarke
D525,869 S 8/2006 Tedford
D527,261 S 8/2006 Hornke
7,100,787 B2 9/2006 Farnsworth
D533,777 S * 12/2006 Hundley ..... D9/447
7,156,251 B2 1/2007 Smith
7,159,732 B2 1/2007 Smith
7,175,042 B2 2/2007 Durdon
7,225,945 B2 6/2007 Crider
7,284,676 B2 10/2007 Dantani
D556,574 S 12/2007 Hollis
D560,120 S 1/2008 Maravich
7,318,536 B2 1/2008 Maravich
7,318,563 B2 1/2008 Houts
7,328,791 B1 2/2008 Bosworth
D564,354 S 3/2008 Maravich
7,353,582 B2 4/2008 MacKenzie
D569,245 S 5/2008 Joshi
D570,685 S 6/2008 Koennecke
D570,686 S * 6/2008 Hollis ..... D9/447
D574,238 S 8/2008 Walker
7,464,831 B2 12/2008 Aiken
7,484,639 B2 2/2009 Maravich
7,513,382 B2 4/2009 Clarke
D592,952 S * 5/2009 Hundley ..... D9/447
7,549,559 B2 6/2009 Conroy
7,676,909 B2 3/2010 MacKenzie
7,691,302 B2 4/2010 Hollis
7,784,641 B2 8/2010 Chou
D624,413 S * 9/2010 Selina ..... D9/447
7,819,271 B2 * 10/2010 Hollis ..... B65D 43/0212 220/254.3
7,845,514 B2 12/2010 Rush
7,992,741 B2 8/2011 Hundley
8,074,331 B2 12/2011 Voges
8,074,831 B2 12/2011 Walker
8,113,379 B2 * 2/2012 Cai ..... B65D 43/0212 220/254.3
8,276,776 B2 * 10/2012 Roth ..... A47G 19/22 220/254.1
8,317,050 B2 11/2012 Hollis
8,430,268 B2 4/2013 Weiss
8,544,677 B2 10/2013 Selina
8,616,405 B2 12/2013 French et al.
D696,940 S 1/2014 Hale
9,034,231 B2 5/2015 Tabor et al.
2002/0027139 A1 3/2002 ONeill
2002/0037378 A1 3/2002 Littlejohn
2002/0189957 A1 12/2002 Gordon
2003/0062272 A1 4/2003 Gordon
2003/0089714 A1 * 5/2003 Dart ..... B65D 43/0212 220/254.3
2003/0089726 A1 * 5/2003 Mazzarolo ..... B65D 43/0256 220/712
2003/0155353 A1 8/2003 Tucker
2003/0192890 A1 10/2003 Mazzarolo
2004/0011803 A1 1/2004 DAmato
2004/0094553 A1 5/2004 Crider
2004/0134911 A1 7/2004 Padovani
2004/0159080 A1 8/2004 Stewart
2004/0178199 A1 9/2004 Stroup
2004/0217033 A1 11/2004 Gordon
2004/0222226 A1 11/2004 Gottainer
2004/0245261 A1 12/2004 Stanos
2005/0051442 A1 3/2005 Gordon
2005/0082177 A1 4/2005 Weiss
2005/0092749 A1 5/2005 Durdon
2005/0109780 A1 5/2005 Pendergrass
2005/0155969 A1 7/2005 Clarke
2005/0167294 A1 8/2005 Swayne
2005/0178766 A1 8/2005 Washington
2005/0210085 A1 9/2005 Bessiere
2005/0224505 A1 10/2005 Brown
2005/0230406 A1 10/2005 Maravich
2005/0263413 A1 12/2005 Harman
2005/0269328 A1 12/2005 Crider
2006/0060589 A1 3/2006 Lee
2006/0071008 A1 4/2006 Sadlier
2006/0096983 A1 5/2006 Patterson
2006/0180028 A1 8/2006 Burchard
2006/0213908 A1 9/2006 Clarke
2006/0226148 A1 * 10/2006 Hundley ..... B65D 43/0212 220/254.3
2006/0255038 A1 * 11/2006 Hollis ..... B65D 43/0212 220/254.3
2007/0007298 A1 1/2007 Tucker
2007/0034629 A1 * 2/2007 Mazzarolo ..... B65D 47/06 220/254.3
2007/0062943 A1 3/2007 Bosworth
2007/0075080 A1 4/2007 Farnsworth
2008/0035681 A1 2/2008 Skillin
2008/0105696 A1 5/2008 Dart
2008/0197134 A1 8/2008 Maxwell
2008/0245792 A1 10/2008 Chou
2009/0223961 A1 * 9/2009 Wang ..... B65D 43/0212 220/281
2009/0266829 A1 10/2009 Bailey
2009/0272742 A1 11/2009 Dybala
2009/0308882 A1 12/2009 Hundley
2010/0037780 A1 2/2010 Pas
2011/0011863 A1 1/2011 Hollis
2012/0024871 A1 2/2012 Hundley
2012/0048856 A1 3/2012 Walker
2012/0132699 A1 5/2012 Mann
2012/0261417 A1 * 10/2012 Tabor ..... B26F 1/40 220/254.1
2012/0272622 A1 11/2012 Weiss
2013/0020338 A1 1/2013 French
2013/0037558 A1 * 2/2013 Selina ..... B65D 21/0219 220/715
2013/0277380 A1 * 10/2013 Koestring ..... B65D 43/02 220/713
2014/0284344 A1 9/2014 French et al.

FOREIGN PATENT DOCUMENTS

CN 99813014 9/1999
DE 20116771 U1 12/2001
DE 20301404 U1 4/2003
WO 0018662 4/2000
WO 0018663 4/2000
WO 0185575 11/2001
WO 03011716 2/2003

(56) References Cited

FOREIGN PATENT DOCUMENTS

| | | |
|---|---|---|
| WO | 2004014776 | 2/2004 |
| WO | 2005013247 A1 | 2/2005 |

OTHER PUBLICATIONS

Office Action dated Sep. 30, 2016 for U.S. Appl. No. 14/214,236.
Chinese Office Action for Chinese App. No. 201480010419.3 dated Dec. 22, 2016, 4 pages.
International Search Report for PCT/US06/32565, dated May 24, 2007.
Supplementary European Search Report dated Apr. 6, 2009, for European Patent Application No. 05735742.8.
International Search Report and Written Opinion dated Jul. 9, 2008, for PCT/US2008/054888.
Supplementary European Search Report dated Jul. 28, 2008, for European Patent Application No. 06813520.1.
International Search Report and Written Opinion for International Application No. PCT/US2014/006277, dated Jul. 15, 2014, 8 pages.
Notice of Non-Final Rejection for U.S. Appl. No. 13/448,050, dated Oct. 8, 2014, 13 pages.
Notice of Non-Final Rejection for U.S. Appl. No. 13/554,771, dated Jun. 7, 2013, 14 pages.
Notice of Non-Final Rejection for U.S. Appl. No. 14/214,236, dated Oct. 3, 2014, 10 pages.
PCT International Search Report and Written Opinion completed by the ISA/US dated Jun. 19, 2014 and issued in connection with PCT/US2014/027067.
Chinese Office Action for Chinese Application No. 201480010419.3, 8 pages.
Chinse Office Action for Chinese Patent Application 201480010419.3 dated Jul. 19, 2016, 8 pages.
Australian Search Report for Australian App. No. 2014240016 dated Mar. 17, 2017, 3 pages.
Office Action dated May 15, 2017 for U.S. Appl. No. 14/214,236.
Singapore Written Opinion for Singapore Patent App. No. 11201507343Y dated Sep, 6, 2017, 6 pages.
Australian Search Report for Australian App. No. 2014240016 dated Aug. 25, 2017, 3 pages.

* cited by examiner 160
14
17A
164
162
173
17
166F
168

17
Outlet Closure
160
168C
172T
172
162
171
173
162
17A
14
Closure Retainer
16
168
166
140R
18
150
165
166R
20R
30
30F
166F
20F
190
140
168F
16B
25
20
21
10
12
24
22

DRINK CUP LID

PRIORITY CLAIM

This application claims priority under 35 U.S.C. §119(e) to U.S. Provisional Application Ser. No. 62/068,320, filed Oct. 24, 2014, which is expressly incorporated by reference herein.

BACKGROUND

The present disclosure relates to drink cups, and particularly to lids for drink cups. More particularly, the present disclosure relates to a lid formed to include a liquid-discharge outlet through which a consumer can sip a beverage contained in a drink cup carrying the lid.

SUMMARY

According to the present disclosure, a liquid container comprises a lid adapted to mate with the brim of a cup. The lid is formed to include a liquid-discharge outlet communicating with an interior region formed in the cup when the lid is mounted on the brim of the cup so that consumers can drink liquid stored in the cup and expelled through the liquid-discharge outlet formed in the lid while the lid is mounted on the brim of the cup.

In illustrative embodiments, the lid includes a central closure formed to include the liquid-discharge outlet and a ring-shaped brim mount arranged to surround the central closure. The brim mount of the lid is configured to mate with the brim of the cup to hold the central closure in a stationary position closing a cup mouth opening into the interior region of the cup and placing the liquid-discharge outlet in fluid communication with any liquid stored in the interior region of the cup.

In illustrative embodiments, the lid further includes an outlet closure mounted for pivotable movement about a pivot axis between a closed position closing the liquid-discharge outlet and an opened position opening the liquid-discharge outlet. The outlet closure is arranged to pivot through an angle of about 150°-180° as it moves from the closed position to the opened position.

In illustrative embodiments, the central closure includes an upstanding drink spout including a generally flat top wall formed to include the liquid-discharge outlet and a side wall depending from the top wall and including a forwardly facing front wall. The generally flat top wall is also formed to include a top aperture arranged to lie in side-by-side relation to the liquid-discharge outlet and between the liquid-discharge outlet and the forwardly facing front wall. The outlet closure includes a closure-anchor lug that is sized and arranged to extend downwardly through the top aperture formed in the top wall into a lug-receiving cavity defined by a closure retainer coupled to the top wall to retain the outlet closure in the closed position at the option of a consumer.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figures 1, 1A:
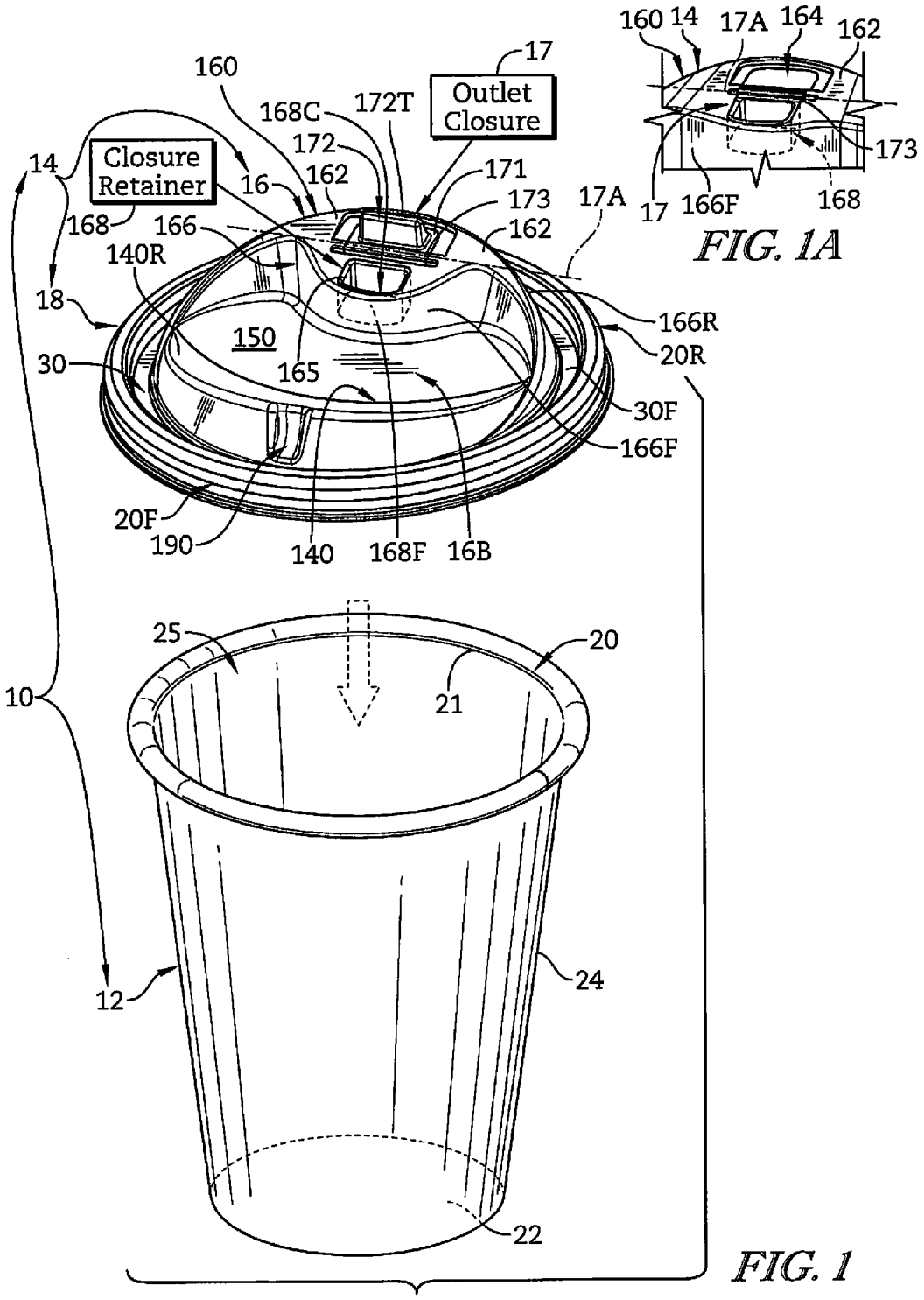
FIG. 1 is a perspective view of a lid in accordance with the present disclosure and a cup before the lid is mounted on the cup and showing that the lid includes a ring-shaped brim mount adapted to mate with the brim of the cup, a central closure surrounded by the brim mount and formed to include an upstanding drink spout, and an outlet closure mounted for pivotable movement between an outlet-closing position shown in FIGS. 1 and 2 and an outlet-opening position shown in FIGS. 1A and 3.
FIG. 1A is a perspective view of a portion of the lid of FIG. 1 showing the outlet closure after it has been pivoted in a forward direction about a horizontal pivot axis to an outlet-opening position and to cause a nose-shaped closure-anchor lug included in the outlet closure to extend downwardly through a top aperture formed in the upwardly facing top wall into an upwardly opening lug-receiving cavity aligned with the top aperture and defined by a closure retainer coupled to the top wall and included in the upstanding drink spout that is shown in FIG. 1 to mate with interior side walls defining the lug-receiver cavity so that the outlet closure is retained temporarily in the outlet-opening position shown in FIG. 1A.
Figure 2:
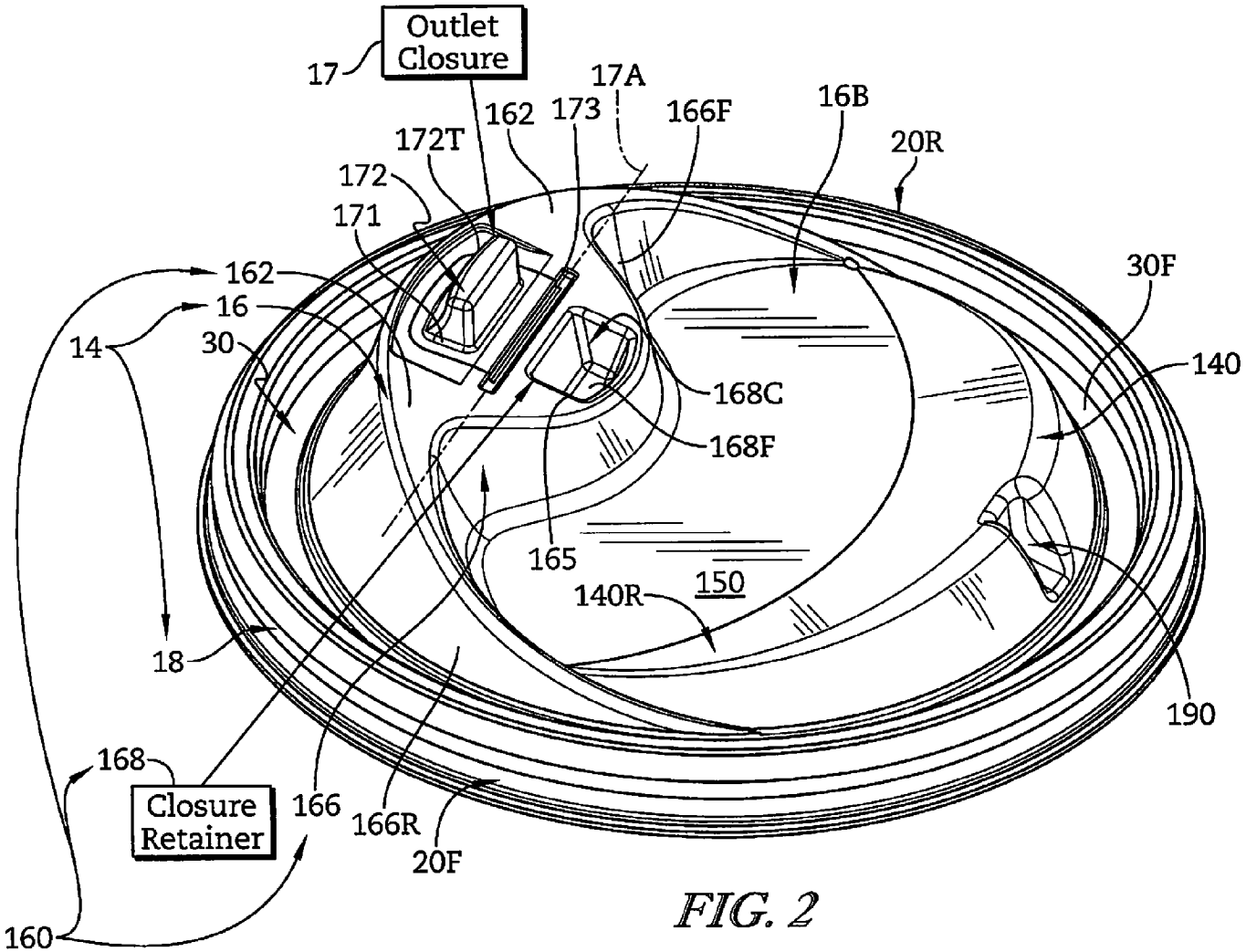
FIG. 2 is an enlarged perspective view of the lid of FIG. 1 showing the outlet closure in the closed position and showing that the top aperture formed in the top wall of the drink spout and aligned with the lug-receiving cavity is located between the liquid-discharge outlet and the serpentine-shaped forwardly facing front wall of the drink spout.

A liquid container 10 in accordance with a first embodiment of the present disclosure includes a cup 12 and a lid 14 as shown in FIGS. 1 and 2. Lid 14 includes a central closure 16 formed to include a liquid-discharge outlet 164, a pivotable outlet closure 17, and brim mount 18 coupled to central closure 16 and configured to be mounted on a brim 20 of cup 12 to arrange central closure 16 to close a cup mouth 21 opening into an interior region 25 formed in cup 12 as suggested in FIG. 1. Lid 14 is made of, for example, polystyrene, polypropylene, or polyethylene using a thermoforming process or other suitable process in illustrative embodiments.

Figures 5, 5A:
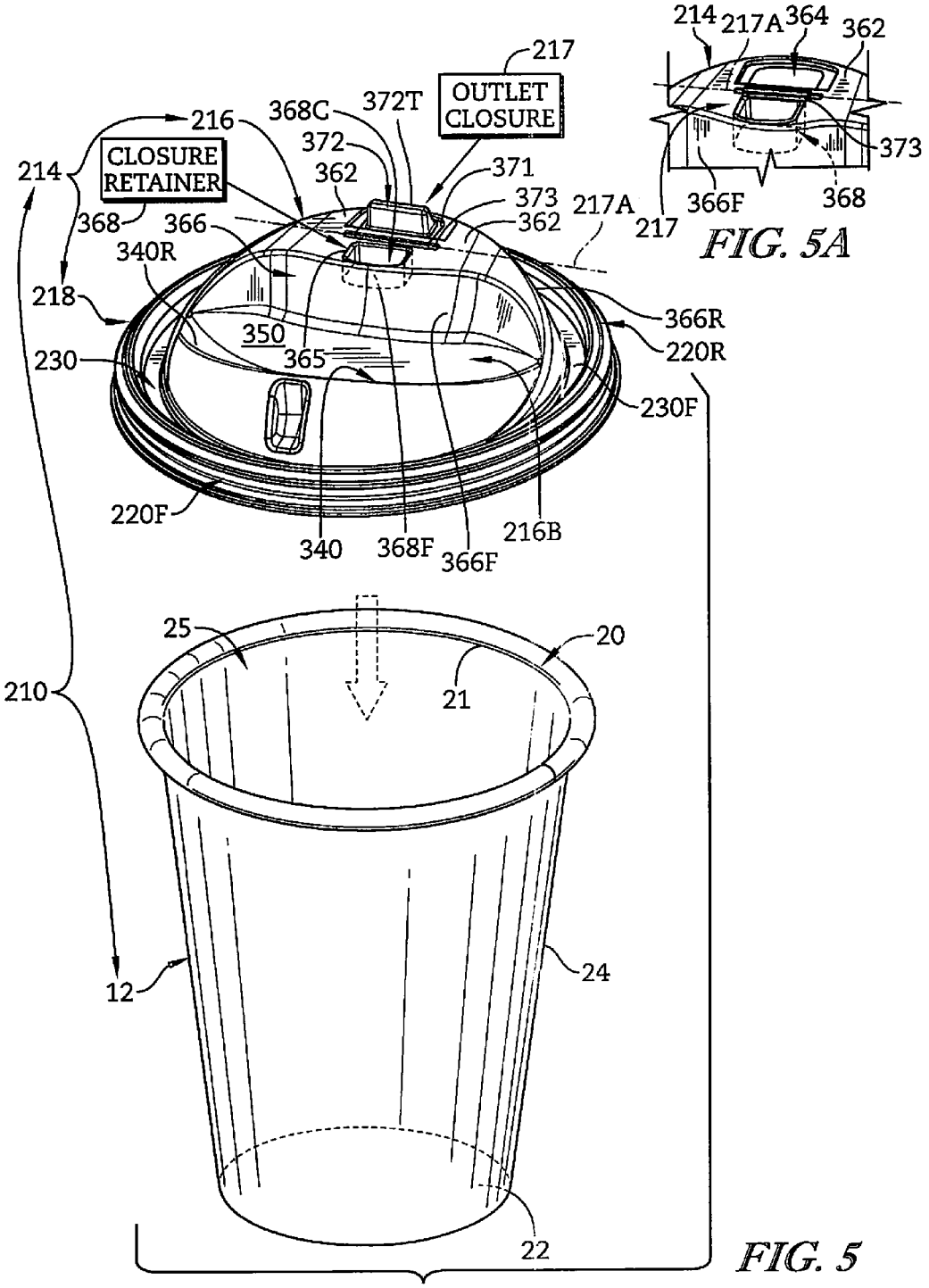
FIG. 5 is a perspective view of a lid in accordance with another embodiment of the present disclosure and a cup before the lid is mounted on the cup and showing that the lid includes a ring-shaped brim mount adapted to mate with the brim of the cup, a central closure surrounded by the brim mount and formed to include an upstanding drink spout, and an outlet closure mounted for pivotable movement between an outlet-closing position shown in FIG. 5 and an outlet-opening position shown in FIG. 5A.
FIG. 5A is a perspective view of a portion of the lid of FIG. 5 showing the outlet closure after it has been pivoted in a forward direction about a horizontal pivot axis to an outlet-opening position and to cause a nose-shaped closure-anchor lug included in the outlet closure to extend downwardly through a top aperture formed in the upwardly facing top wall into an upwardly opening lug-receiving cavity aligned with the top aperture and defined by a closure retainer coupled to the top wall and included in the upstanding drink spout that is shown in FIG. 5 to mate with interior side walls defining the lug-receiver cavity so that the outlet closure is retained temporarily in the outlet-opening position shown in FIG. 5A.

A liquid container 210 in accordance with a second embodiment of the present disclosure is shown in FIGS. 5 and 5A. Liquid container 210 includes cup 12 and a lid 214 adapted to be mounted on brim 20 of cup 12. The shape of lid 214 is very similar to the shape of lid 14 as can be seen in FIGS. 1 and 5.

Figure 4A:
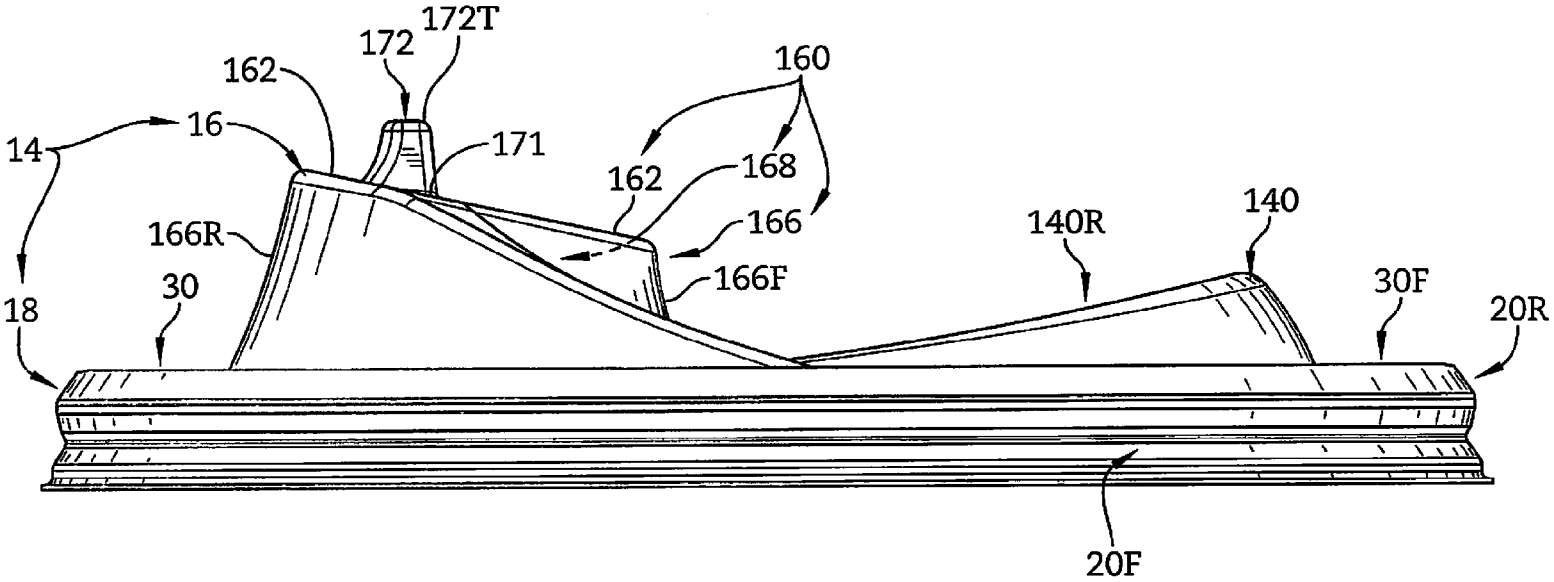
FIG. 4A is a side elevation view of the lid shown in FIG. 2 showing the outlet closure in the outlet-closing position to cause the nose-shaped closure anchor of the outlet closure to extend upwardly away from the generally horizontal top wall of the upstanding drink spout.
Figure 4B:
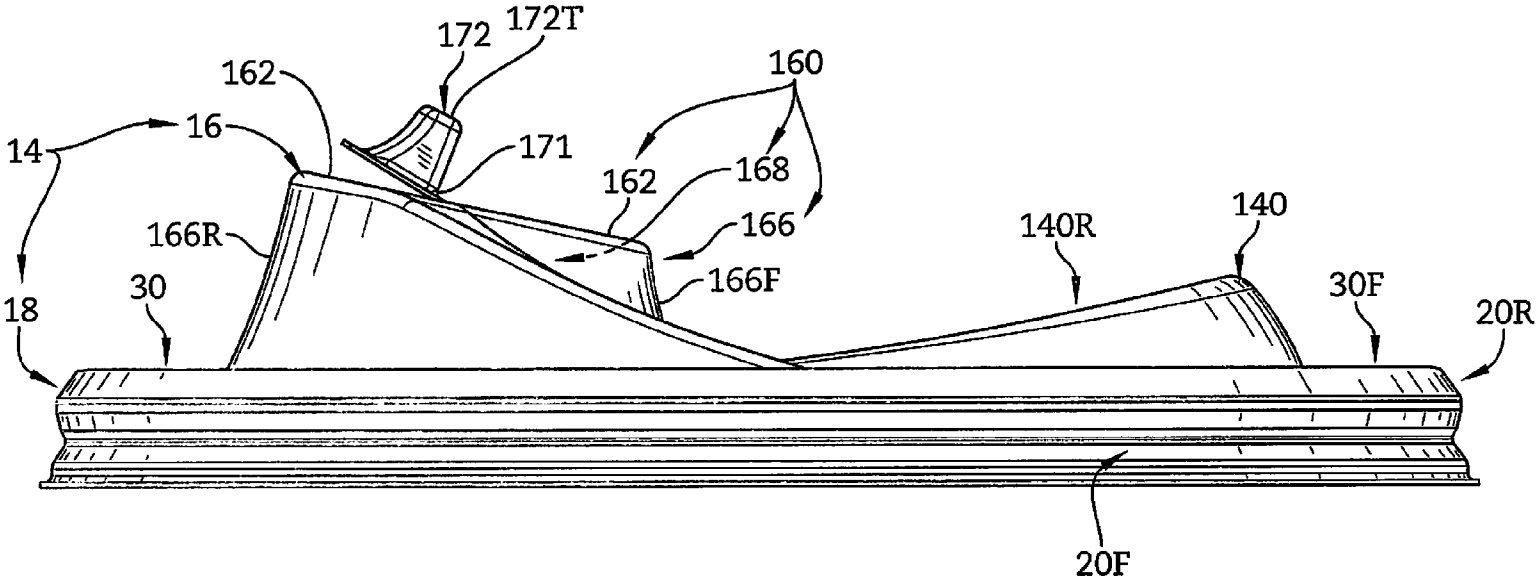
FIG. 4B is a view similar to FIG. 4A showing the orientation of the outlet closure during pivoting movement of the outlet closure from the outlet-closing position shown in FIGS. 1, 2, and 4A to the outlet-opening position shown in FIGS. 1A, 3, and 4C.

Central closure 16 includes a drink spout 160 including a generally horizontal top wall 162 and a closure retainer 168 coupled to an underside of top wall 162 as suggested in FIGS. 1 and 4A. Top wall 162 is formed to include a liquid-discharge outlet 164 and a top aperture 165 opening into a lug-receiving cavity 168C formed in closure retainer 168 as suggested in FIGS. 1 and 1A. Drink spout 160 also includes a side wall 166 extending around a perimeter edge of top wall 162 and including a forwardly facing front wall 166F arranged to extend downwardly from a front edge of top wall 162. The top aperture 165 is formed in top wall 162 to lie in a position that is located between liquid-discharge outlet 164 and the forwardly facing front wall 166F as suggested in FIG. 1.

Figure 3:
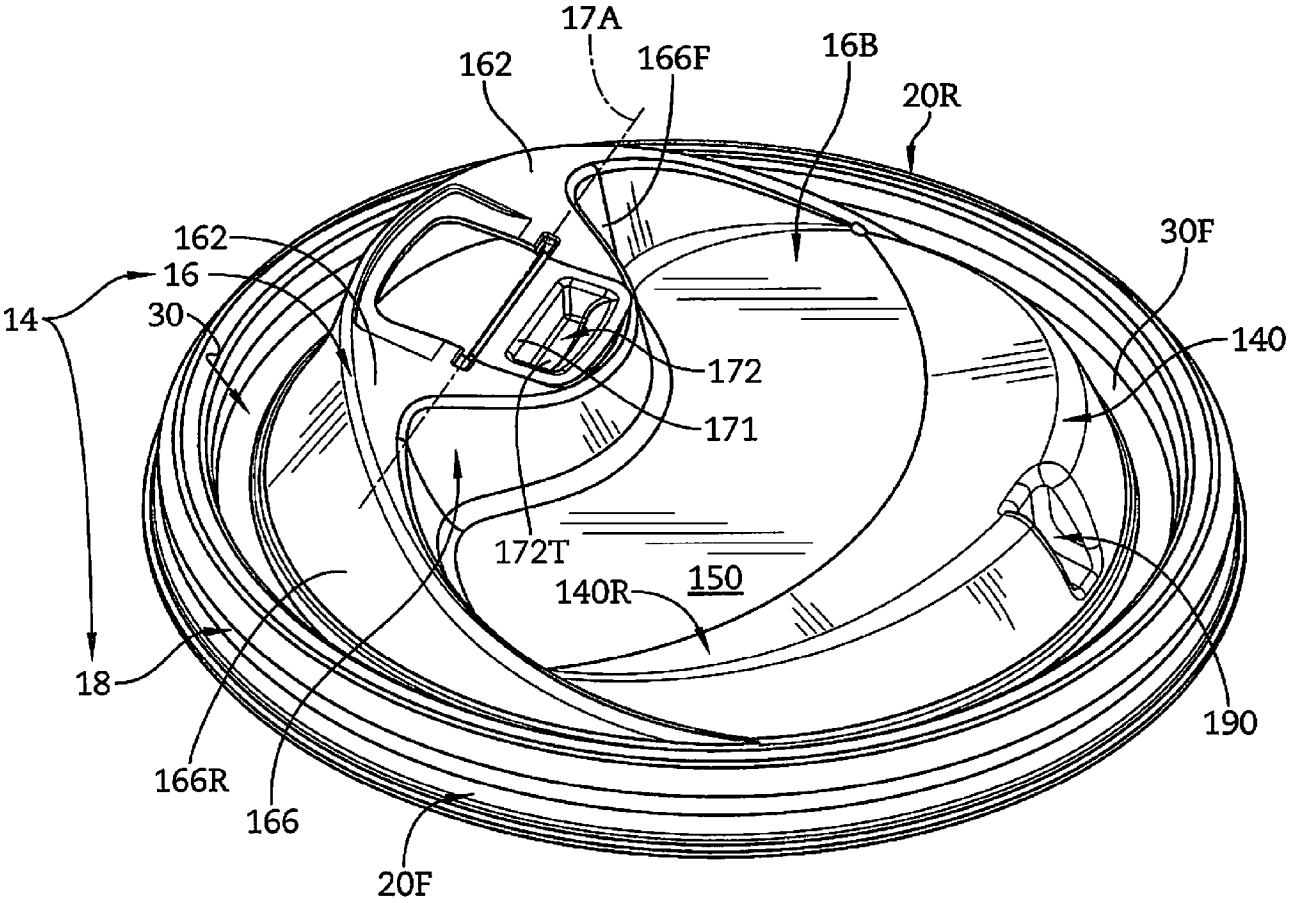
FIG. 3 is a perspective view similar to FIG. 2 showing the outlet closure retained in the outlet-opening position.
Figure 3A:
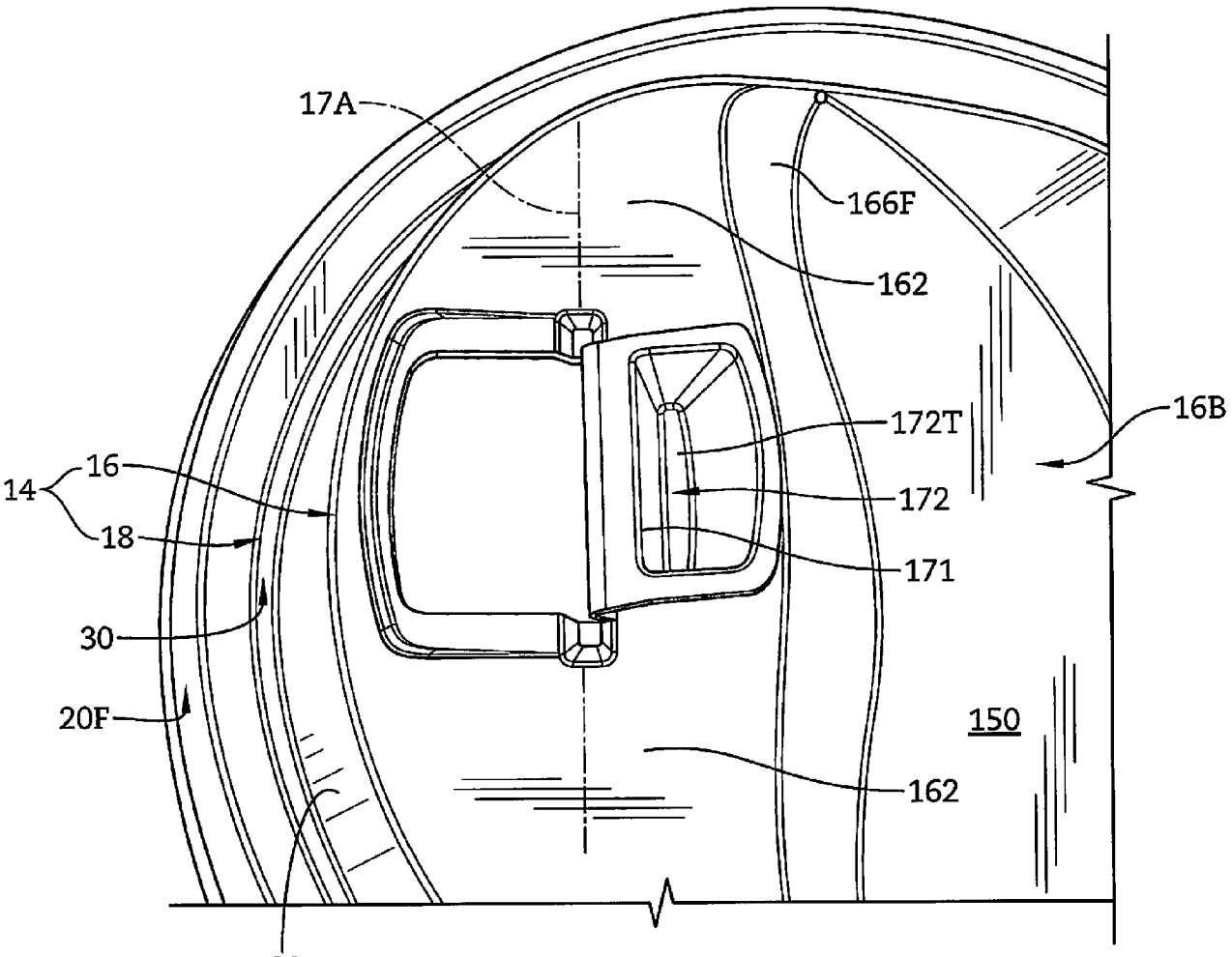
FIG. 3A is an enlarged view similar to FIG. 2A showing that the liquid-discharge outlet formed in the top wall of the drink spout has been opened in response to pivoting movement of the outlet closure to the outlet-opening position in which the nose-shaped closure-anchor lug of the outlet closure is extended through the top aperture formed in the top wall and into the underlying lug-receiving cavity formed in the closure retainer that is coupled to the underside of the top wall of the drink spout.

Outlet closure 17 is mounted on central closure 16 for pivotable movement about pivot axis 17A between a closed position closing liquid-discharge outlet 164 as shown in FIGS. 1 and 2 and an opened position opening liquid-discharge outlet 164 and mating with the closure retainer 168 provided under top wall 162 of drink spout 160 to retain outlet closure 17 in an opened position as shown in FIGS. 1A, 3, and 3A. It is within the scope of this disclosure to add one or more rigidifying features to top wall 162 in a region near closure retainer 168 to minimize unwanted deflection of top wall 162 during mating engagement of outlet closure 17 and closure retainer 168.

As shown in FIGS. 1 and 2, cup 12 includes a brim 20, a floor 22, and a side wall 24 extending upwardly from floor 22 to brim 20. Side wall 24 and floor 22 cooperate to form interior region 25 of cup 12. It is within the scope of this disclosure to make cup 12 out of any suitable plastics, paper, or other material(s).

In an illustrative embodiment, a consumer can drink liquid stored in cup 12 while lid 14 remains mounted on the brim 20 of cup 12 through the opened liquid-discharge outlet 164 formed in lid 14 after the consumer has pivoted outlet closure 17 to an opened position. In an illustrative embodiment, central closure 16 of lid 14 includes an upstanding drink spout 160 formed to include liquid-discharge outlet 164. Drink spout 160 is adapted to be received in the mouth of a consumer desiring to drink a liquid stored in cup 12 once outlet closure 17 has been moved to an opened position.

Central closure 16 rises upwardly above brim mount 20 and includes an upstanding ridge 140 that is located inside a front semicircular portion 20F of brim mount 20 and a drink spout 160 that is formed to include a high-elevation liquid-discharge outlet 164 and is located inside a rear semicircular portion 20R of brim mount 20 in spaced-apart confronting relation to ridge 140 as suggested in FIGS. 1 and 2. Any liquid stored in interior region 25 of cup 12 is in fluid communication with the liquid-discharge outlet 164 formed in the generally horizontal top wall 162 of the upstanding drink spout 160 as suggested in FIG. 1. Each of the upstanding drink spout 160 and ridge 140 is somewhat crescent-shaped in an illustrative embodiment as shown, for example, in FIG. 2.

In illustrative embodiments, upstanding drink spout 160, ridge 140, and a concave football-shaped basin floor 150 located between drink spout 160 and ridge 140 cooperate to form an elevated basin 16B included in central closure 16 as suggested in FIGS. 1 and 2. The football-shaped basin floor 150 is substantially flat in an illustrative embodiment and lies between a forwardly facing front wall 166F of the crescent-shaped drink spout 160 and a rearwardly facing concave rear wall 140R of the crescent-shaped ridge 140. Floor 30F of ring-shaped low-elevation liquid-retention channel 30 surrounds ridge 140, basin floor 150, and drink spout 160 as suggested in FIGS. 1 and 2.

Outlet closure 17 includes an annular closure plate 171, an upstanding nose-shaped closure-anchor lug 172 coupled to an inner edge of annular closure plate 171, and a hinge 173 coupled to a forwardly facing segment of an outer edge of annular closure plate 171 and to drink spout 160 along horizontally extending pivot axis 17A as shown, for example, in FIGS. 1 and 2. Annular closure plate 171 is a flange coupled to a lower edge of upstanding nose-shaped closure-anchor lug 172 and arranged to extend outwardly therefrom to lie in substantially coplanar relation to top wall 162 of drink spout 160 when outlet closure 17 occupies the closed position as suggested in FIG. 3. Lid 14 is thermoformed to position outlet closure 17 normally in the closed position in an illustrative embodiment. It is within the scope of this disclosure to provide closure-anchor lug 172 with any suitable shape so long as it is retained by closure retainer 168 in an opened position as disclosed herein.

Figure 2A:
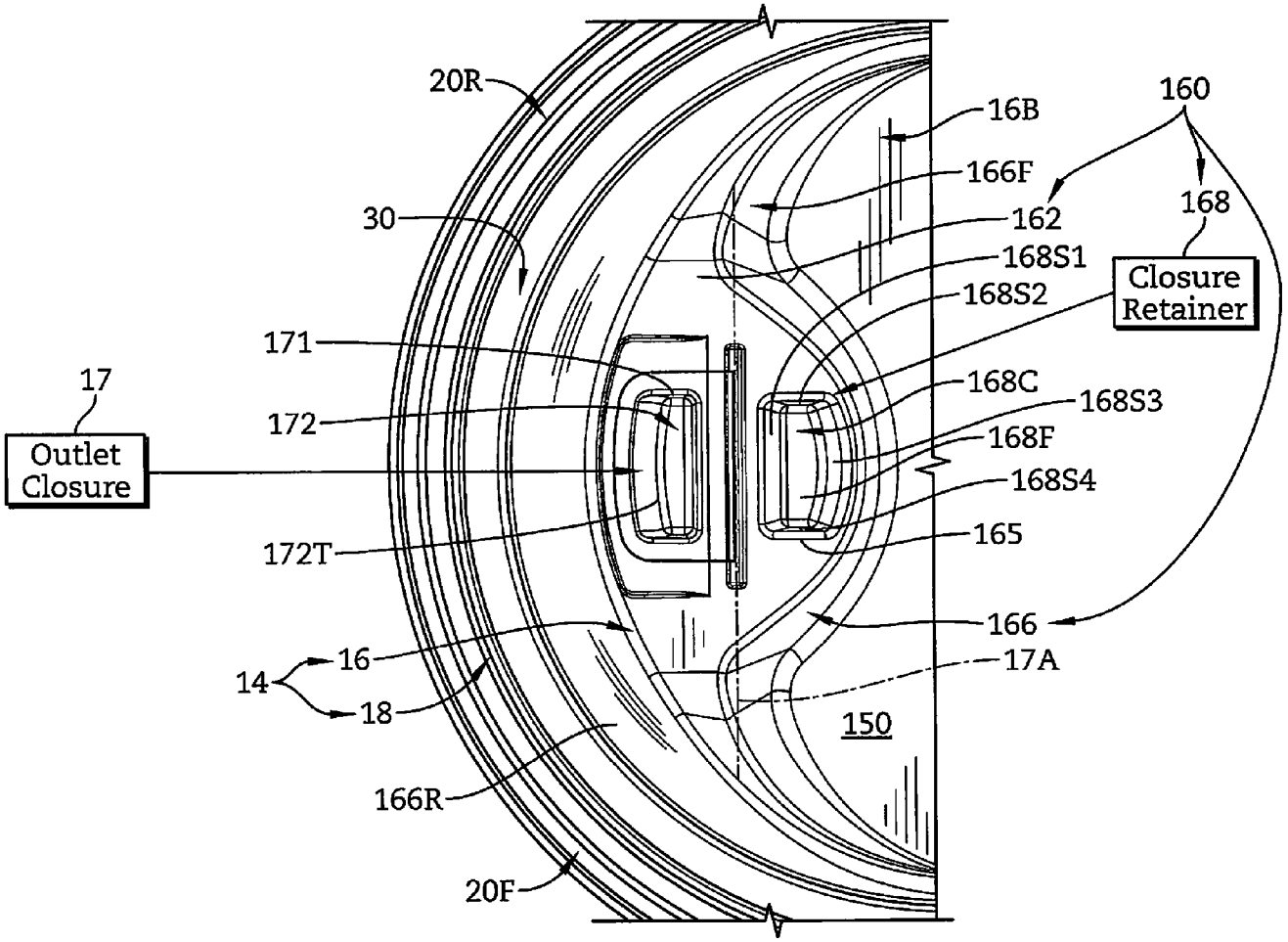
FIG. 2A is an enlarged partial top plan view of the lid of FIG. 2 showing the outlet closure in the closed position and showing the top aperture formed in the generally horizontal top wall of the drink spout and the four cavity side walls and floor that cooperate to define the lug-receiving cavity aligned with the top aperture formed in the top wall.

Closure retainer 168 is formed to include an upwardly facing lug-receiving cavity 168C that is sized to receive the tip of the nose-shaped closure-anchor lug 172 of outlet closure 17 therein when outlet closure 17 is pivoted by the user to the opened position shown in FIG. 1A. Lug-receiving cavity 168C is bounded by an endless series of four cavity side walls 168S1, 168S2, 168S3, and 168S4 and a generally horizontal floor 168F coupled to lower edges of each of the cavity side walls 168S1-4 as suggested in FIG. 2A. These cavity side walls cooperate to define interference-fit means for temporarily retaining the nose-shaped closure-anchor lug 172 of outlet closure 17 in lug-receiving cavity 168 upon movement of outlet closure 17 to the opened position shown, for example, in FIGS. 3 and 3A. It is within the scope of the present disclosure to vary the shape of lug-receiving cavity 168 and bordering portions of top wall 162 to rigidify or reinforce lug-receiving cavity 168 to minimize deformation of lug-receiving cavity 168 and a surrounding border region during insertion of nose-shaped closure-anchor lug 172 into lug-receiving cavity 168C.

A drink cup lid 14 includes a ring-shaped brim mount 18 adapted to mate with a brim 20 of a drink cup 12 and a central closure 16 surrounded by brim mount 20 and formed to include an upstanding drink spout 160 as shown, for example, in FIGS. 1 and 2. The upstanding drink spout 160 has a top wall 162 formed to include a liquid-discharge outlet 164 and an adjacent top aperture 165. Drink spout 160 also has a side wall 166 arranged to extend downwardly from top wall 162 toward an interior region surrounded by the ring-shaped brim mount 20 as suggested in FIG. 2.

Drink cup lid 14 further includes an outlet closure 17 and a closure retainer 168 as suggested in FIGS. 1 and 2. Outlet closure 17 is coupled to the upstanding drink spout 160 for movement about a horizontally extending pivot axis 17A between a closed position closing the liquid-discharge outlet 164 formed in top wall 162 of the upstanding drink spout 160 as shown in FIG. 1 and an opened position away from the liquid-discharge outlet 164 as shown in FIG. 1A.

Outlet closure 17 includes an annular closure plate 171, an upstanding nose-shaped closure-anchor lug 172 coupled to an inner edge of annular closure plate 171, and a hinge 173 coupled to annular closure plate 171 and to drink spout 160 and configured to establish horizontal pivot axis 17A. Hinge 173 is coupled to a portion of upstanding drink spout 160 along a junction provided between top aperture 165 and liquid-discharge outlet 164 as suggested in FIGS. 2 and 2A.

Figure 4C:
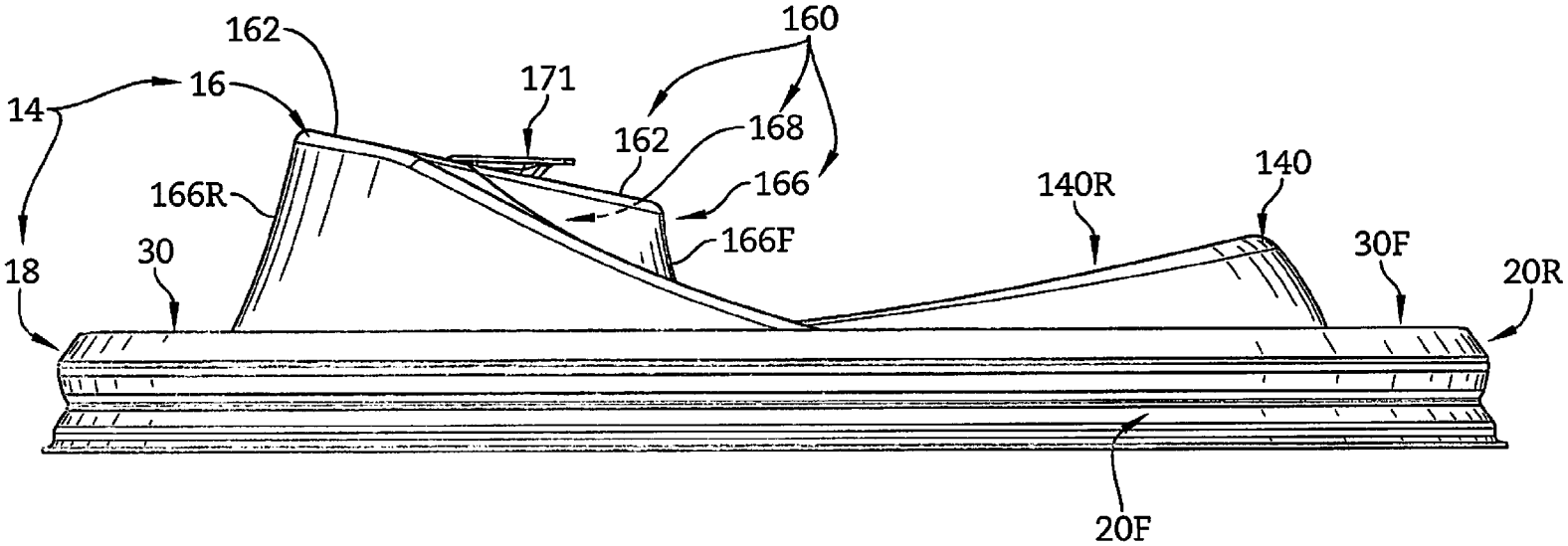
FIG. 4C is a view similar to FIGS. 4A and 4B showing the orientation of the outlet closure upon arrival at the outlet-opening position shown in FIGS. 1A and 3.

Outlet closure 17 includes a nose-shaped closure anchor lug 172 configured to mate with closure retainer 168 and remain in a stationary position relative to central closure 16 upon movement of outlet closure 17 to the opened position as suggested in FIGS. 1A, 3, and 3A. Closure retainer 168 is coupled to top wall 162 and is formed to include a forwardly facing lug-receiving cavity 168C and side walls 168S1-4 as suggested in FIG. 2A that cooperate to provide detent means for retaining a tip 172T of nose-shaped closure-anchor lug 172 in lug-receiving cavity 168C upon movement of outlet closure 17 to the opened position as suggested in FIGS. 3, 3A, and 4C.

Side wall 166 of the upstanding drink spout 160 includes an upstanding front wall 166F appended to a front edge of top wall 162 and an upstanding rear wall 166R appended to a rear edge of top wall 162 to locate top wall 162 and its liquid-discharge outlet 164 and top aperture 165 between the rear and front walls 166R, 166F. The rear and top walls 166R, 162 cooperate to define sipper means for extending into the mouth of a consumer desiring to drink a liquid stored in a cup 12 mated with the ring-shaped brim mount 18 through the liquid-discharge outlet 164 once outlet closure 17 has been moved to the opened position. Rear wall 166R has a convex shape and the front wall 166F has a serpentine shape as suggested in FIG. 2. Outlet closure 17 is mounted for pivotable movement through an angle of about 150°-170° about pivot axis 17A between a closed position closing the liquid-discharge outlet 164 and an opened position opening the liquid-discharge outlet 164 and mating with a closure retainer 168 formed in central closure 16 as shown, for example, in FIG. 3.

A liquid container 20 in accordance with a second embodiment of the present disclosure includes a cup 12 and a lid 214 as shown in FIGS. 5 and 5A. Lid 214 includes a central closure 216 formed to include a liquid-discharge outlet 364, a pivotable outlet closure 217, and brim mount 218 coupled to central closure 216 and configured to be mounted on a brim 20 of cup 12 to arrange central closures 216 to close a cup mouth 21 opening into an interior region 25 formed in cup 12 as suggested in FIG. 5.

Central closure 216 includes a drink spout 360 including a generally horizontal top wall 362 and a closure retainer 368 coupled to an underside of top wall 362 as suggested in FIG. 5. Top wall 362 is formed to include a liquid-discharge outlet 364 and a top aperture 365 opening into a lug-receiving cavity 368C formed in closure retainer 368 as suggested in FIG. 5. Drink spout 360 also includes a side wall 366 extending around a perimeter edge of top wall 362 and including a forwardly facing front wall 366F arranged to extend downwardly from a front edge of top wall 362 and a rearwardly facing rear wall 366R arranged to extend downwardly from a rear edge of top wall 362. The top aperture 365 is formed in top wall 362 to lie in a position that is located between liquid-discharge outlet 364 and the forwardly facing front wall 366F as suggested in FIG. 5.

Outlet closure 217 is mounted on central closure 216 for pivotable movement about pivot axis 217A between a closed position closing liquid-discharge outlet 364 as shown in FIG. 5 and an opened position opening liquid-discharge outlet 364 and mating with the closure retainer 368 provided under top wall 362 of drink spout 360 to retain outlet closure 217 in an opened position as shown in FIG. 5A. Drink spout 360 is adapted to be received in the mouth of a consumer desiring to drink a liquid stored in cup 12 once outlet closure 217 has been moved to an opened position.

Central closures 216 rises upwardly above brim mount 220 and includes an upstanding ridge 340 that is located inside a front semicircular portion 220F of brim mount 220 and a drink spout 360 that is formed to include a high-elevation liquid-discharge outlet 364 and is located inside a rear semicircular portion 220R of brim mount 220 in spaced-apart confronting relation to ridge 340 as suggested in FIG. 5. Any liquid stored in interior region 25 of cup 12 is in fluid communication with the liquid-discharge outlet 364 formed in the generally horizontal top wall 362 of the upstanding drink spout 360 as suggested in FIG. 5.

In illustrative embodiments, upstanding drink spout 360, ridge 340, and a concave football-shaped basin floor 350 located between drink spout 360 and ridge 340 cooperate to form an elevated basin 216B included in central closure 216 as suggested in FIG. 5. The football-shaped basin floor 350 is somewhat bowl-shaped and lies between a forwardly facing front wall 366F of the crescent-shaped drink spout 360 and a rearwardly facing concave rear wall 340R of the crescent-shaped ridge 340. Floor 230F of ring-shaped low-elevation liquid-retention channel 230 surrounds ridge 340, basin floor 350, and drink spout 360 as suggested in FIG. 5.

Outlet closure 217 includes an annular closure plate 371, an upstanding nose-shaped closure-anchor lug 372 coupled to an inner edge of annular closure plate 371, and a hinge 373 coupled to a forwardly facing segment of an outer edge of annular closure plate 371 and to drink spout 360 along horizontally extending pivot axis 217A as shown, for example, in FIGS. 5 and 5A. Annular closure plate 371 is a flange coupled to a lower edge of upstanding nose-shaped closure-anchor lug 372 and arranged to extend outwardly therefrom to lie in substantially coplanar relation to top wall 362 of drink spout 360 when outlet closure 217 occupies the closed position as suggested in FIG. 5. Lid 214 is thermoformed to position outlet closure 217 normally in the closed position in an illustrative embodiment.

The invention claimed is:

1. A drink cup lid comprising a ring-shaped brim mount adapted to mate with a brim of a drink cup, a central closure surrounded by the brim mount and formed to include an upstanding drink spout having a top wall formed to include a top aperture and an adjacent liquid-discharge outlet and a front wall arranged to extend downwardly from the top wall toward an interior region surrounded by the ring-shaped brim mount, the interior region located radially inward relative to the top wall, an outlet closure coupled to the top wall of the upstanding drink spout for movement about a horizontally extending pivot axis between a closed position closing the liquid-discharge outlet formed in the top wall of the upstanding drink spout and an opened position away from the liquid-discharge outlet, and closure retainer means aligned with the top aperture and coupled to the top wall for retaining the outlet closure in a stationary position relative to the front wall upon movement of the outlet closure from the closed position to the opened position.

2. The drink cup lid of claim 1, wherein the outlet closure includes an annular closure plate, an upstanding nose-shaped closure-anchor lug coupled to an inner edge of the annular closure plate, and a hinge coupled to the annular closure plate and to the drink spout and configured to establish the horizontal pivot axis.

3. The drink cup lid of claim 2, wherein the hinge is coupled to a portion of the upstanding drink spout along a junction provided on the top wall between the liquid-discharge outlet and the top aperture.

4. The drink cup lid of claim 1, wherein the outlet closure includes a nose-shaped closure anchor lug configured to extend downwardly through the top aperture formed in the top wall and to mate with the closure retainer means and remain in a stationary position relative to the central closure upon movement of the outlet closure to the opened position.

5. The drink cup lid of claim 4, wherein the closure retainer means is formed to include an upwardly facing lug-receiving cavity aligned with the top aperture formed in the top wall and cavity side walls arranged to bound the lug-receiving cavity and configured to provide detent means for retaining a tip of the nose-shaped closure-anchor lug in the lug-receiving cavity upon movement of the outlet closure to the opened position.

6. The drink cup lid of claim 5, wherein the closure retainer means includes a nearly vertical cavity rear wall, a nearly vertical cavity front wall, a pair of laterally spaced-apart cavity side walls arranged to extend from the cavity rear wall to the cavity front wall in a direction away from the liquid-discharge outlet to form the upwardly facing lug-receiving cavity therebetween, and a floor arranged to mate with the cavity front and rear walls and interconnect lower edges of the cavity side walls.

7. The drink cup lid of claim 1, wherein the closure retainer is formed to include an upwardly facing lug-receiving cavity bounded by a cavity rear wall, a cavity front wall, a pair of laterally spaced-apart cavity side walls arranged to extend from the cavity rear wall away from the liquid-discharge outlet to the cavity front wall, and a floor arranged to mate with cavity rear wall and interconnect lower edges of the cavity side walls, and the outlet closure includes a nose-shaped closure-anchor lug arranged to extend downwardly through the top aperture formed in the top wall and into the upwardly facing lug-receiving cavity upon movement of the outlet closure to the opened position.

8. The drink cup lid of claim 1, wherein-side walls of the upstanding drink spout includes the front wall appended to a front edge of the top wall and an upstanding rear wall appended to a rear edge of the top wall to locate the top wall between the rear and front walls, the liquid-discharge outlet and the top aperture are formed in the top wall to lie between the rear and front walls, and the rear and top walls cooperate to define sipper means for extending into the mouth of a consumer desiring to drink a liquid stored in a cup mated with the ring-shaped brim mount through the liquid-discharge outlet once the outlet closure has been moved to the opened position.

9. The drink cup lid of claim 8, wherein the closure retainer means includes a cavity rear wall, a cavity front wall, a pair of laterally spaced-apart cavity side walls arranged to extend from the cavity rear wall to the cavity front wall in a direction away from the liquid-discharge outlet and the upstanding rear wall to form the upwardly facing lug-receiving cavity therebetween, and a floor arranged to mate with the cavity front and rear walls and interconnect lower edges of the cavity side walls.

10. The drink cup lid of claim 8, wherein the rear wall has a convex shape and the front wall has a serpentine shape.

11. The drink cup lid of claim 1, further comprising a rear wall appended to the top wall and arranged to extend downwardly toward a ring-shaped low-elevation liquid-retention channel.

* * * * *